US009831554B2

(12) United States Patent
Tsai

(10) Patent No.: US 9,831,554 B2
(45) Date of Patent: Nov. 28, 2017

(54) ANTENNA APPARATUS

(71) Applicant: TRANS ELECTRIC CO., LTD., Changhua (TW)

(72) Inventor: Kun-Cheng Tsai, Changhua (TW)

(73) Assignee: TRANS ELECTRIC CO., LTD., Changhua (TW)

( * ) Notice: Subject to any disclaimer, the term of this patent is extended or adjusted under 35 U.S.C. 154(b) by 67 days.

(21) Appl. No.: 15/173,829

(22) Filed: Jun. 6, 2016

(65) Prior Publication Data

US 2017/0222335 A1 Aug. 3, 2017

(30) Foreign Application Priority Data

Jan. 28, 2016 (TW) ..... 105201291 A

(51) Int. Cl.
*H01Q 21/00* (2006.01)
*H01Q 5/371* (2015.01)
*H01Q 9/28* (2006.01)

(52) U.S. Cl.
CPC ..... *H01Q 5/371* (2015.01); *H01Q 9/285* (2013.01)

(58) Field of Classification Search
CPC ..... H01Q 5/371; H01Q 9/285
USPC ..... 343/893
See application file for complete search history.

(56) References Cited

U.S. PATENT DOCUMENTS

2017/0033459 A1* 2/2017 Tsai ..... H01Q 1/38

* cited by examiner

*Primary Examiner* — Graham Smith
(74) *Attorney, Agent, or Firm* — McClure, Qualey & Rodack, LLP

(57) ABSTRACT

An antenna apparatus includes a pair of antenna units that are symmetrical with respect to a symmetrical axis. Each of the antenna units has a substantially annular shape with an opening, and includes a high-frequency radiating part, a low-frequency radiating part which is spaced apart from the high-frequency radiating part, and a conductor part which interconnects the high-frequency radiating part and the low-frequency radiating part. The high-frequency radiating part, the low-frequency radiating part and the conductor part are divided into at least five metal conductors which are connected in sequence and each of which has a convex quadrilateral shape.

10 Claims, 5 Drawing Sheets

ANTENNA APPARATUS

CROSS-REFERENCE TO RELATED APPLICATION

This application claims priority of Taiwanese Patent Application No. 105201291, filed on Jan. 28, 2016.

FIELD

The disclosure relates to an antenna apparatus, and more particularly to an antenna apparatus having matched impedance with a thin design.

BACKGROUND

An antenna for receiving digital television signals transmitted by a wireless television station serves as an interface between a media device and an environment of signal transmission. The antenna is configured for conversion between an electrical signal and an electromagnetic signal, and is further configured to generate a suitable radiation pattern through its own antenna structure, so as to lower the attenuation rate at a specific frequency and to promote Signal-to-Noise ratio (SNR) of a received signal.

Referring to FIG. 1, a conventional antenna apparatus 710 for receiving digital television signals is shown. The conventional antenna apparatus 710 is disposed on dielectric substrate 720 having a symmetrical axis (L). The dielectric substrate 720 is substantially rectangular. The conventional antenna apparatus 710 has a pair of coupling radiating parts 711, which are symmetrical to each other with respect to the symmetrical axis (L). The two coupling radiating parts 711 define an empty space 712 which is substantially triangular. The slow wave effect may be achieved by virtue of equivalent capacitance and equivalent inductance resulting from the coupling radiating parts 711 of the conventional antenna apparatus 710, so that a balun circuit can be omitted. However, an area occupied by the coupling radiating parts 711 on the dielectric substrate 720 is excessively large and thus incurs higher manufacturing cost. The attenuation rate of the conventional antenna apparatus 710 is presented in a dotted line depicted in FIG. 5, and is required to be improved within a digital television frequency band ranging from 470 MHz to 700 MHz.

SUMMARY

Therefore, an object of the disclosure is to provide an antenna apparatus that can alleviate at least one of the drawbacks of the prior art.

According to the disclosure, the antenna apparatus includes a pair of antenna units that are symmetrical with respect to a symmetrical axis. Each of the antenna units has a substantially annular shape with an opening, and includes a high-frequency radiating part, a low-frequency radiating part which is spaced apart from the high-frequency radiating part, and a conductor part. which interconnects the high-frequency radiating part and the low-frequency radiating part. The high-frequency radiating part, the low-frequency radiating part and the conductor part are divided into at least five metal conductors which are connected in sequence and each of which has a convex quadrilateral shape.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
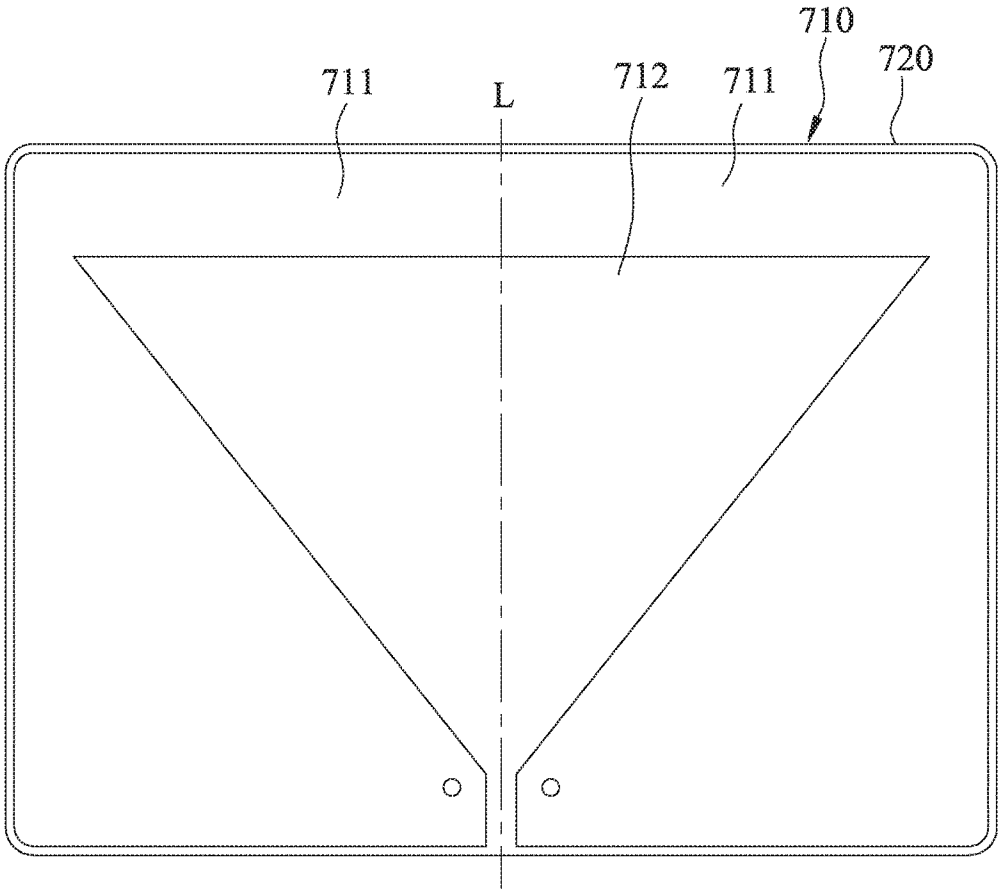
FIG. 1 PRIOR ART
FIG. 1 is a schematic view of a conventional antenna apparatus.

Before the disclosure is described in greater detail, it should be noted that where considered appropriate, reference numerals or terminal portions of reference numerals have been repeated among the figures to indicate corresponding or analogous dements, which may optionally have similar characteristics.

Figure 2:
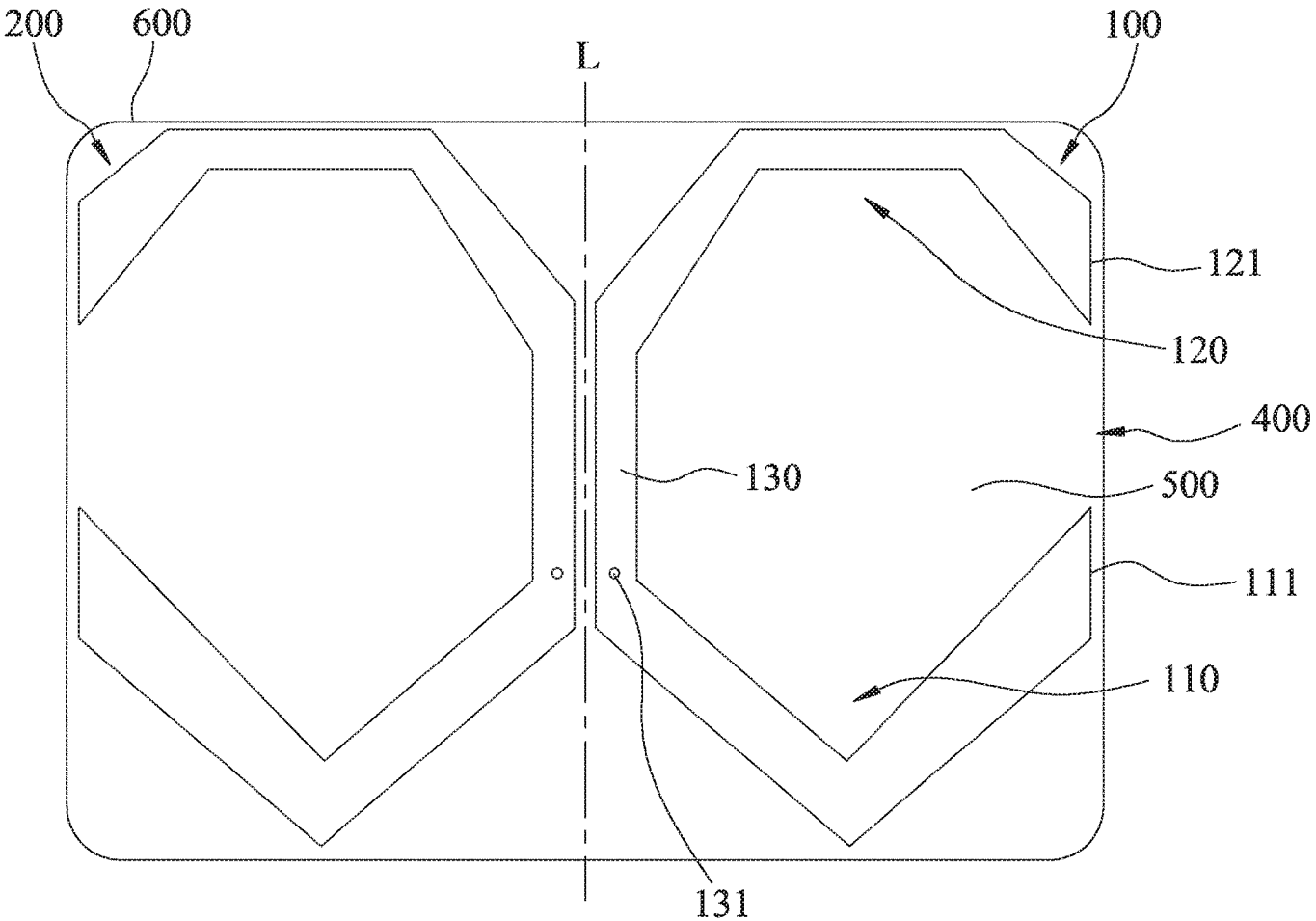
FIG. 2 is a schematic view illustrating one embodiment of an antenna apparatus of the disclosure.

Referring to FIG. 2, an embodiment of an antenna apparatus according to this disclosure is capable of directly receiving an unbalanced signal without a balun circuit. The antenna apparatus is disposed on a dielectric substrate 600 having a symmetrical axis (L). The dielectric substrate 600 is made of dielectric material, such as plastic, fiberglass, etc. The antenna apparatus is formed on the dielectric substrate 600 by forming metal conductor patterns (such as patterns made of silver, copper, etc.) on the dielectric substrate 600. According to different requirements, the dielectric substrate 600 may have flexibility or different colors.

The embodiment of the antenna apparatus includes a pair of antenna units 100 and 200 that are symmetrical with respect to the symmetrical axis (L). The antenna unit 100 has a substantially annular shape with an opening 400. In this embodiment, the antenna unit 100 is substantially C-shaped. The antenna unit 100 includes a high-frequency radiating part 110, a low-frequency radiating part 120 which is spaced apart from the high-frequency radiating part 110, and a conductor part 130 which is disposed between and interconnects the high-frequency radiating part 110 and the low-frequency radiating part 120. The high-frequency radiating part 110, the low-frequency radiating part 120 and the conductor part 130 may be deemed to be divided into six metal conductors which are connected in sequence and each of which has a convex quadrilateral shape.

The high-frequency radiating part 110 has a high-frequency distal end 111, and the low-frequency radiating part 120 has a low-frequency distal end 121. The high-frequency distal end 111 and the low-frequency distal end 121 are parallel with the symmetrical axis (L) and are spaced apart from each other by the opening 400. The conductor part 130 is provided with a feed-in point 131.

In order to omit the balun circuit which is ordinarily used to feed a dipole antenna, impedance of each of the six metal conductors should be carefully designed, such that the impedance of the antenna apparatus is able to suppress a current of high frequency which is generated in response to receipt of a signal and which is to be directed to a shield layer of a coaxial cable (not shown) that is electrically connected to the feed-in point 131. In this way, the current of high-frequency may be prevented from affecting a radiation pattern and an electric field of the antenna apparatus.

Therefore, details of the antenna apparatus, such as materials, dimensions and configurations of the metal conductors, should be considered.

Figure 3:
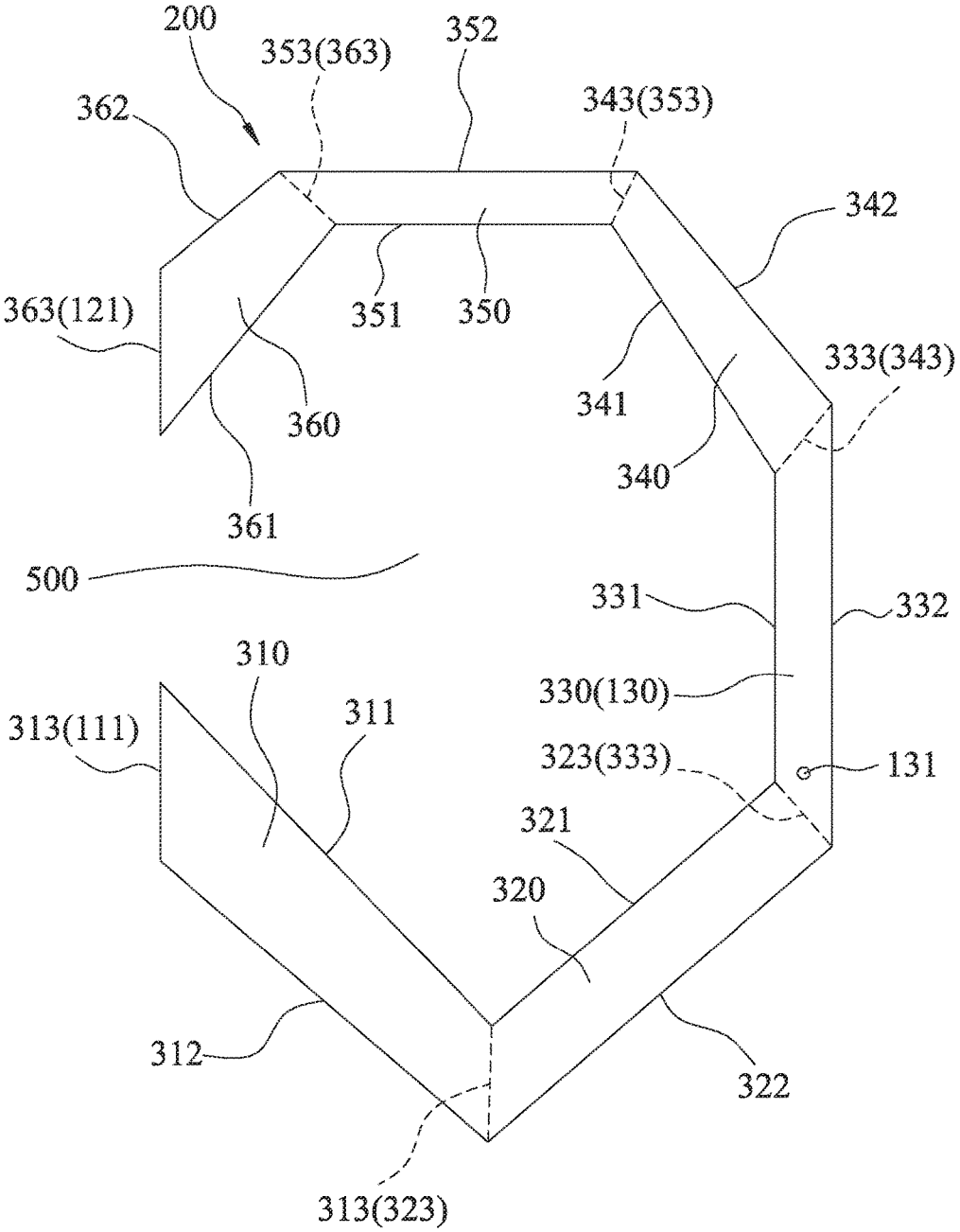
FIG. 3 is a schematic view illustrating an antenna unit of the embodiment of the antenna apparatus which is formed by six metal conductors.

Since structural configuration of the antenna unit 100 is the same as that of the antenna unit 200, only the antenna unit. 200 is described hereinafter for the sake of brevity. FIG. 3 shows the more detailed structure of the antenna unit 200. The antenna unit 200 is divided into the six metal conductors 310, 320, 330, 340, 350 and 360 (collectively denoted by 310-360 hereinafter) according to turning points of the antenna apparatus. With reference to the elements of the antenna unit 100 depicted in FIG. 2, the combination of the metal conductors 310 and 320 corresponds to the high-frequency radiating part 110, the combination of the metal conductors 340, 350 and 360 corresponds to the low-frequency radiating part 120, and the metal conductor 330 corresponds to the conductor part 130. In another embodiment of the antenna apparatus of the disclosure, the antenna unit 200 may be divided into five metal conductors. In other words, the combination of the three metal conductors 340, 350 and 360 which corresponds to the low-frequency radiating part 120 may be replaced with a combination of only two metal conductors. In further another embodiment, the antenna apparatus may be divided into more than six metal conductors. It should be noted that the greater the number of metal conductors, the greater the number of length and shape parameters required to be considered.

Each of the six metal conductors 310-360 has an inner edge 311, 321, 331, 341, 351, 361 (collectively denoted by 311-361 hereinafter), an outer edge 312, 322, 332, 342, 352, 362 (collectively denoted by 312-362 hereinafter), and two side edges 313, 323, 333, 343, 353 363 (collectively denoted by 313-363 hereinafter) interconnecting the inner edge 311-361 and the outer edge 312-362. For example, the metal conductor 310 has the inner edge 311, the outer edge 312, and the two side edges 313. Each of the other metal conductors 320-360 has a similar structure. The inner edges 311-361 of the six metal conductors 310-360 define an empty space 500 that is encircled by the antenna unit 200 and that is in spatial communication with the opening 400 (see FIG. 2). An included angle between the inner edges of any adjacent two metal conductors of the metal conductors 310-360 is greater than 90 degrees so that the empty space 500 is substantially oval-shaped. In this way, not only do the antenna units 100 and 200 have larger expanded dimensions, but fewer electric charges will be accumulated at a turning point between the inner edges of the any adjacent two metal conductors 310-360. Moreover, the outer edge 332 of the metal conductor 330 that corresponds to the conductor part 130 is disposed in a direction parallel with the symmetrical axis (L).

The dimensions and shapes of the metal conductors 310-360 and the impedance and the materials of the metal conductors 310-360 are interrelated, so they should be carefully designed. Moreover, one of the two side edges of one of any adjacent two metal conductors of the six metal conductors 310-360 has a length identical to that of an adjacent one of the two side edges of another one of the any adjacent two metal conductors. The any adjacent two metal conductors of the six metal conductors 310-360 are connected to each other with the adjacent side edges joined together. One of the side edges 313 of the metal conductor 310 which is not connected to another side edge is the high-frequency distal end 111 of the high-frequency radiating part 110. Similarly, one of the side edges 363 of the metal conductor 360 which is not connected to another side edge is the low-frequency distal end 121 of the low-frequency radiating part 120. Moreover, the lengths of the high-frequency distal end 111 and the low-frequency distal end 121 play a significant role in deciding the quality of the signal received by the antenna apparatus, especially for a signal at the very high frequency (VHF) band. Moreover, the lengths are positively correlated to the quality of the signal thus received, and thus should not be excessively short. Each of the lengths is at least 30 mm. A maximum length of each of the high-frequency distal end 111 and the low-frequency distal end 121 is associated with the dimensions of the antenna apparatus. For this embodiment of the disclosure, each of the lengths is not greater than 55 mm.

A length of the inner edge 311 is between 80 mm and 120 mm. A length of the outer edge 312 is between 70 mm and 110mm. A length of the side edge 313 (323) at which the metal conductors 310 and 320 are connected is between 20 mm and 30 mm. A length of the inner edge 321 is between 60 mm and 90 nm. A length of the outer edge 322 is between 75 mm and 115 mm. A length of the side edge 323 (333) at which the metal conductors 320 and 330 are connected is between 15 mm and 25 mm. A length of the inner edge 331 is between 50 mm and 80 mm. A length of the outer edge 332 is between 70 mm and 120 mm. A length of the side edge 333 (343) at which the metal conductors 330 and 340 are connected is between 15 mm and 25 mm. A length of the inner edge 341 is between 45 mm and 75 mm. A length of the outer edge 342 is between 50 mm and 80 mm. A length of the side edge 343 (353) at which the metal conductors 340 and 350 are connected is between 10 mm and 15 mm. A length of the inner edge 351 is between 50 mm and 75 mm. A length of the outer edge 352 is between 60 mm and 90 mm. A length of the side edge 353 (363) at which the metal conductors 350 and 360 are connected is between 15 mm to 25 mm. A length of the inner edge 361 is between 50 mm and 75 mm. A length of the outer edge 362 is between 30 mm and 60 mm.

According to the concept of designing a dipole antenna, the greater an angle between two conductive elements of the dipole antenna, the greater the signal reception rate at a relative lower frequency, such as at VHF, and the worse the signal reception at a relatively higher frequency, such as at UHF (Ultra High Frequency). 90 degrees is a relatively balanced angle for dipole antennas operating at these two frequency bands. Thus, an angle between the outer edges 342 of the antenna units 100 and 200 is designed to range from 80 degrees to 120 degrees in order to achieve better reception performance at low frequency, and an angle between the outer edges 322 of the antenna units 100 and 200 is designed to range from 50 degrees to 100 degrees in order to achieve better reception performance at high frequency. A distance between the outer edges 332 of the antenna units 100 and 200 is between 5 mm and 15 mm.

Figure 4:
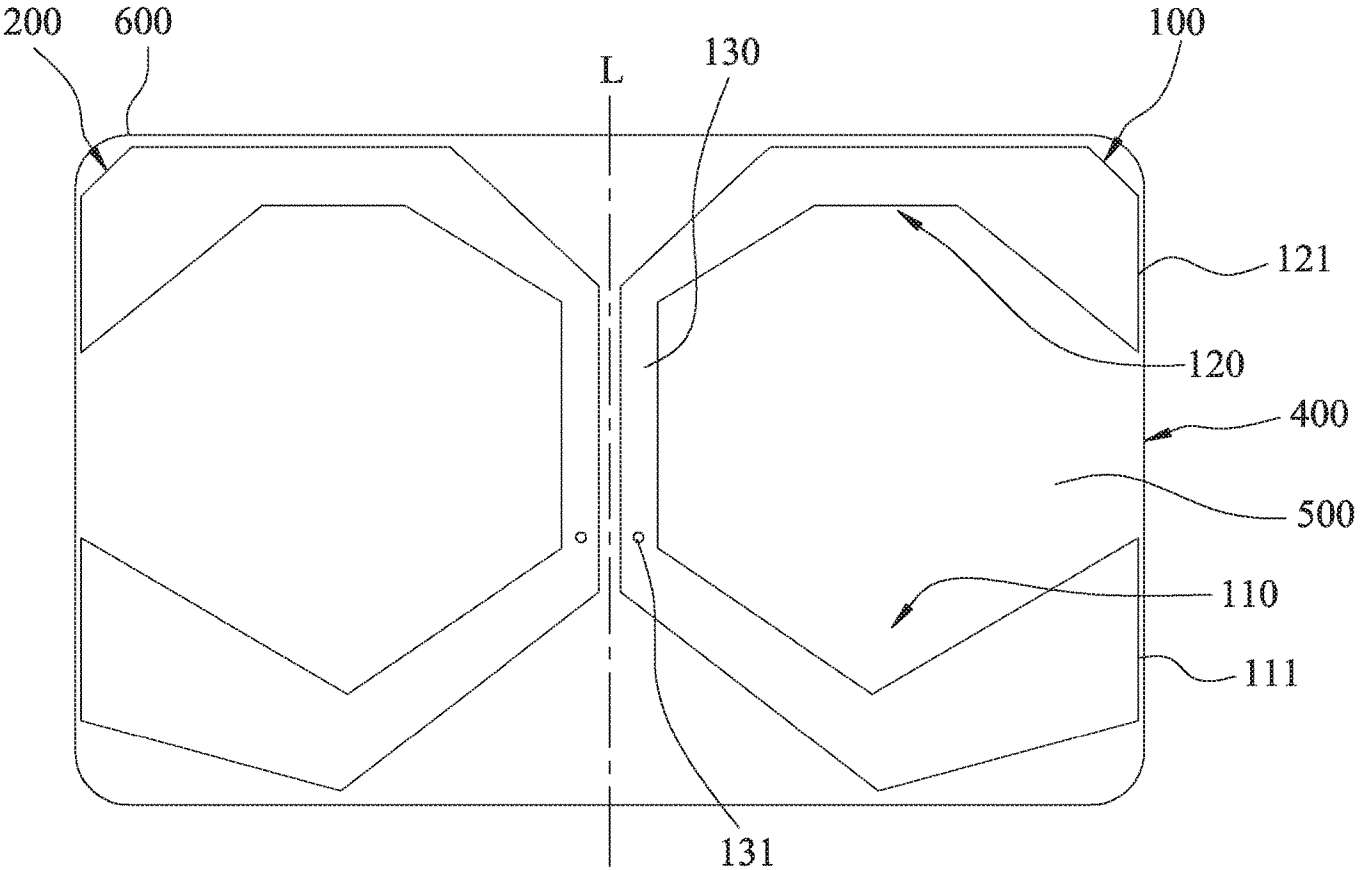
FIG. 4 is a schematic view illustrating another embodiment of the antenna apparatus with different dimensions and shape.

In this embodiment, the material of the antenna units 100, 200 is silver which has the highest electrical conductivity for lowering the impedance of the antenna units 100 and 200. Thus, an area of the antenna units 100 and 200 can be reduced. However, in other embodiments, the material not limited to silver and might be a mixture of other kinds of metal for lowering the manufacturing cost. FIG. 4 shows another embodiment of the antenna apparatus of the disclosure, while impedance matching is considered for different impedance resulting from different materials.

Figure 5:
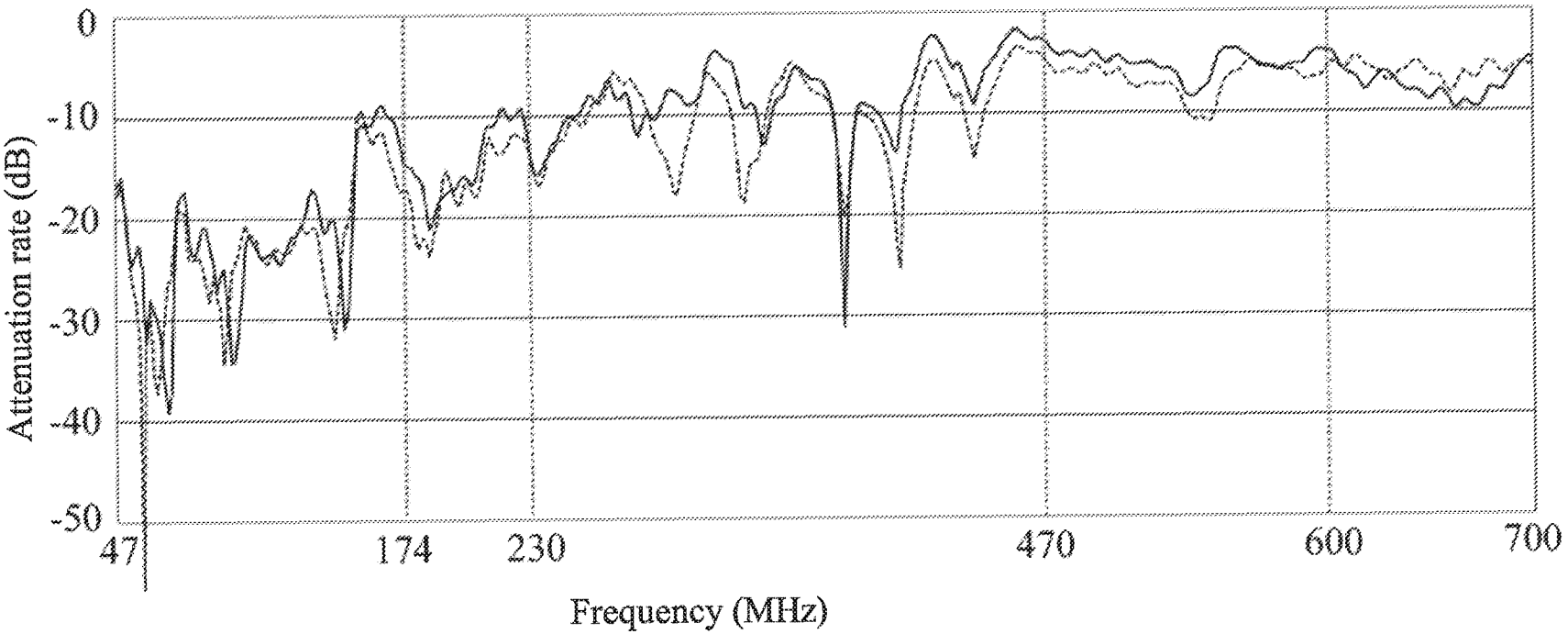
FIG. 5 is a diagram illustrating the attenuation rates of the conventional antenna apparatus and an embodiment of the antenna apparatus according to the disclosure.

The high-frequency radiating parts 110 of the antenna units 100 and 200 are configured to operate together to receive a signal at a high-frequency band. An effective current path from the high-frequency distal end 111 to the feed-in point 131 for each one of the antenna units 100 and 200 is about 125 mm, which is substantially equal to one quarter wavelength at the central frequency of the high-frequency band ranging from 400 MHz to 800 MHz. On the other hand, the low-frequency radiating parts 120 of the antenna units 100 and 200 are configured to operate together to receive a signal at a low-frequency band. The effective current path from the low-frequency distal end 121 to the feed-in point 131 for each one of the antenna units 100 and 200 is about 375 mm, which is substantially equal to one quarter wavelength at the central frequency of the low-frequency band ranging from 150 MHz to 250 MHz Referring to FIG. 5, attenuation rates of an embodiment of the antenna apparatus (solid line) and the conventional antenna apparatus (dotted line) operating in a frequency band between 47 MHz and 700 MHz are shown. The attenuation rate of the antenna apparatus of the disclosure is superior to that of the conventional antenna apparatus when operating at the frequency band for digital television which is from, 470 MHz to 600 MHz The attenuation rate of the antenna apparatus is also superior to that of the conventional antenna apparatus when operating at the frequency band for radio broadcasting which is from 174 MHz to 230 MHz.

In this embodiment, the six metal conductors 310-360 are formed in one piece. In other embodiments, the antenna apparatus might be formed by separate metal conductors which are combined together to have the same shape with the antenna apparatus illustrated in FIG. 1.

In sum, with the impedance matching between the metal conductors 310-360, the balun circuit may be omitted, and the area of the antenna units 100 and 200 may be greatly reduced in order to lower the manufacturing cost. Moreover, the performance of the antenna apparatus for receiving the digital television signals is improved, and the antenna apparatus is also operable for receiving the radio broadcasting signals.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment, " an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. An antenna apparatus comprising a pair of antenna units that are symmetrical with respect to a symmetrical axis, each of said antenna units having a substantially annular shape with an opening, and including:

a high-frequency radiating part;

a low-frequency radiating part which is spaced apart from said high-frequency radiating part; and a conductor part which interconnects said high-frequency radiating part and said low-frequency radiating part; and wherein said high-frequency radiating part, said low-frequency radiating part and said conductor part are divided into at least five metal conductors which are connected in sequence and each of which has a convex quadrilateral shape.

2. The antenna apparatus as claimed in claim 1, wherein each of said at least five metal conductors has an inner edge, an outer edge, and two side edges interconnecting said inner edge and said outer edge, said inner edges of said at least five metal conductors defining an empty space that is encircled by each of said antenna units and that is in spatial communication with the opening; and wherein one of said two side edges of one of any adjacent two metal conductors of said at least five metal conductors has a length identical to that of an adjacent one of said two side edges of another one of said any adjacent two metal conductors, and an included angle between said inner edges of said any adjacent two metal conductors is greater than 90 degrees.

3. The antenna apparatus as claimed in claim 2, wherein said conductor part is formed by one metal conductor of said at least five metal conductors, said outer edge of said one metal conductor being parallel with the symmetrical axis.

4. The antenna apparatus as claimed in claim 1, wherein said conductor part is provided with a feed-in point.

5. The antenna apparatus as claimed in claim 4, wherein said high-frequency radiating part has a high-frequency distal end, and said low-frequency radiating part has a low-frequency distal end, said high-frequency distal end and said low-frequency distal end being parallel with the symmetrical axis and being spaced apart from each other by the opening.

6. The antenna apparatus as claimed in claim 5, wherein said high-frequency radiating parts of said antenna units are configured to operate together to receive a signal at a high-frequency band, an effective current path from said high-frequency distal end to said feed-in point for each one of said antenna units being substantially equal to one quarter wavelength at the central frequency of the high-frequency band.

7. The antenna apparatus as claimed in claim 6, wherein the high-frequency band ranges from 400 MHz to 800 MHz.

8. The antenna apparatus as claimed in claim 5, wherein said low-frequency radiating parts of said antenna units are configured to operate together to receive a signal at a low-frequency band, an effective current path from said low-frequency distal end to said feed-in point for each one of said antenna units being substantially equal to one quarter wavelength at the central frequency of the low-frequency band.

9. The antenna apparatus as claimed in claim 8, wherein the low-frequency band ranges from 150 MHz to 250 MHz.

10. The antenna apparatus as claimed in claim 5, wherein each of said high-frequency distal end and said low-frequency distal end has a length between 30 mm and 55 mm.

* * * * *